United States Patent [19]

Burk

[11] 4,047,277

[45] Sept. 13, 1977

[54] TRACK LINK PIN BORE - HYDRAULICALLY PRESTRETCHED

[75] Inventor: Duane L. Burk, East Peoria, Ill.

[73] Assignee: Caterpillar Tractor Co., Peoria, Ill.

[21] Appl. No.: 595,650

[22] Filed: July 14, 1975

[51] Int. Cl.[2] ..... B23P 17/00; B23P 19/02

[52] U.S. Cl. ..... 29/421 R; 29/446; 29/525; 72/56; 138/31

[58] Field of Search ..... 72/56, 61, 60; 29/421 R, 446, 525; 60/413, 414; 138/31

[56] References Cited

U.S. PATENT DOCUMENTS

| | | | |
|---|---|---|---|
| 202,435 | 4/1878 | Grimshaw | 138/31 |
| 345,360 | 7/1886 | Boehme | 138/31 |
| 650,755 | 5/1900 | Huber | 72/56 |
| 1,329,762 | 2/1920 | Guy | 29/446 |
| 2,337,247 | 2/1943 | Kepler | 29/446 |
| 2,424,087 | 7/1947 | Focke et al. | 29/525 |
| 2,713,314 | 7/1955 | Leuthesser, Jr. et al. | 72/61 |
| 3,015,345 | 1/1962 | Michael | 138/31 |
| 3,394,569 | 7/1968 | Smith | 29/421 |
| 3,438,114 | 4/1969 | Berman et al. | 29/446 |
| 3,535,901 | 5/1967 | Tominaga | 72/61 |
| 3,862,557 | 1/1975 | Zeitlin | 72/60 |
| 3,969,812 | 7/1976 | Beck | 29/421 R |

FOREIGN PATENT DOCUMENTS

| | | | |
|---|---|---|---|
| 900,740 | 7/1962 | United Kingdom | 29/525 |

*Primary Examiner*—C.W. Lanham
*Assistant Examiner*—Daniel C. Crane
*Attorney, Agent, or Firm*—Phillips, Moore, Weissenberger, Lempio & Majestic

[57] ABSTRACT

A method and apparatus for enlarging a bore in a work piece including means for sealing the bore, a source of hydraulic fluid and a hydraulic pressure amplifier for introducing the fluid into the cylindrical bore and amplifying the pressure of the fluid to a value exceeding the yield strength of the work piece, thereby forcing the walls of the bore to yield until the bore reaches a predetermined diameter. The hydraulic amplifier means includes a plurality of series connected cylinders of increasing diameter so that the fluid acting on each cylinder is multiplied by the pressure of the preceding cylinder.

3 Claims, 2 Drawing Figures

TRACK LINK PIN BORE - HYDRAULICALLY PRESTRETCHED

BACKGROUND OF THE INVENTION

The present invention relates to the art of manufacture and pertains particularly to method and apparatus for the sizing of cylindrical bores.

Many machines and articles of manufacture includes the use of cylindrical pins or shafts tight fitting into cylindrical bores. Such pins are normally press fitted into the bores and are required to maintain their position in the bore under considerable stress.

In order to insure proper fitting of such pins and bores, it is necessary to maintain fairly precise tolerances between the pin and bore. Tolerances are difficult to maintain without the use of numerous expensive operations. For example, bores may be formed by drilling and then bored or machined to a predetermined diameter. As the boring tool wears, the hole or bore becomes smaller. This may require another machining operation in order to obtain the proper size bore. One of the problems of such machining operations is that they are expensive. Another problem with such operations is that, as a finer cut is taken to more precisely size the bore, the finish within the bore becomes very smooth. Such finishes are undesirable when the walls of the bore are required to hold a pin or the like in place therein.

One approach to the problem of sizing bores, is disclosed in U.S. Pat. No. 3,691,805. The problem with such approach, however, is that the bore within the work piece becomes highly finished; and thus, incapable of tightly gripping and retaining a pin extended therein.

SUMMARY AND OBJECTS OF THE INVENTION

It is the primary object of the present invention to overcome the above problems of the prior art.

Another object of the present invention is to provide a simple and inexpensive method for the sizing of bores in a work piece which also reduces the amount of inelastic deformation of the bore when a final press fit is made.

A further object of the present invention is to provide simple and inexpensive method and apparatus for the sizing of a bore in a work piece.

In accordance with the primary aspect of the present invention, a bore in a work piece is formed to a first predetermined size and thereafter a hydraulic fluid or the like is introduced into the bore and increased in pressure to a value exceeding the yield strength of the work piece, thereby, forcing the walls of the bore to a second predetermined bore diameter. Suitable hydraulic amplifying means is utilized for increasing the pressure of the hydraulic fluid.

BRIEF DESCRIPTION OF THE DRAWING

The above and other objects and advantages of the present invention will become apparent from the following description when read in conjunction with the accompanying drawings herein.

DETAILED DESCRIPTION OF THE PREFERRED EMBODIMENT

Figure 1:
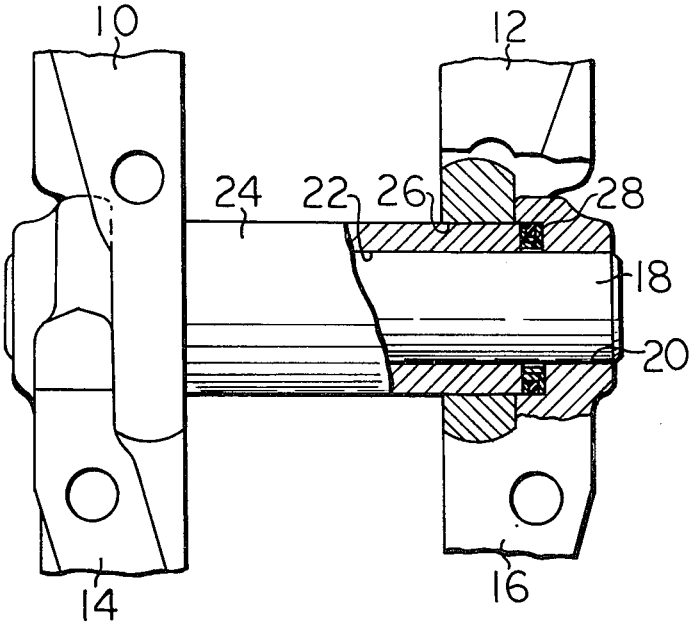
FIG. 1 is a view partially in section of a track link constructed in accordance with the present invention; and, FIG. 2 is an elevational view in section of an apparatus in accordance with the present invention for carrying out the method of the present invention.

Turning now to the drawing, particularly FIG. 1, there is illustrated a chain or track link assembly comprising link members 10 and 12 pivotally connected to link members 14 and 16 by means of a pin 18. The pin 18 is press fitted within a bore of links 14 and 16 such as shown at 20 in link 16. The pin 18 is rotatably mounted within a bore 22 of a sleeve 24. The sleeve 24, in turn, is press fitted within bores in links 10 and 12 as shown at 26 of link 12. Suitable seal means 38 is provided in the joint to seal lubricant within the joint assembly.

In order to press fit the pin 18 within the bore 20, it is necessary that a predetermined interference fit exists between the pin 18 and the bore 20. The interference fit must be maintained at a very close tolerance in order that the links can be properly assembled. Should the bore 20 become too small as by or the result of excessive wear of the drilling or boring tool forming the bore 20, the pin 18 cannot be properly pressed with the bore. On the other hand, should the bore 20 be too large in relation to the pin 18 a loose fit will be established and the links will not stay assembled. It is also desirable that a fairly rough finish be maintained on the surfaces of the pin 18 and the bore or walls of the bore 20 in order to increase the gripping force or friction between these members.

From an economic standpoint, it is desirable that the bore 20 be formed to its predetermined maximum diameter in as few operations as necessary. However, since such bores as bores 20 and 26 are normally formed in a boring or drilling operation by a boring or drilling tool the bore becomes smaller as the tool wears. It thus becomes necessary to form the bore to its final diameter by taking increasingly small cuts from a first rough boring of the bore. This results in multiple operations, as well as, frequently resulting in a very highly polishing or finishing of the bores when very fine cuts are taken.

In accordance with the present invention, the bore is finished or formed to a first predetermined diameter and thereafter a pressurized fluid is introduced into the bore and the pressure thereof increased to apply a force on the cylindrical walls of the cylindrical bore to force the walls of the bore outward exceeding the yield strength of the work piece until the walls of the bore yield to a second or final diameter for the bore.

This is carried out in the case of an open or through bore by sealing one end of the bore by suitable seal means and sealingly engaging the other end by suitable pressurized fluid-applying means and increasing the pressure of the fluid to the desired pressure level.

Figure 2:
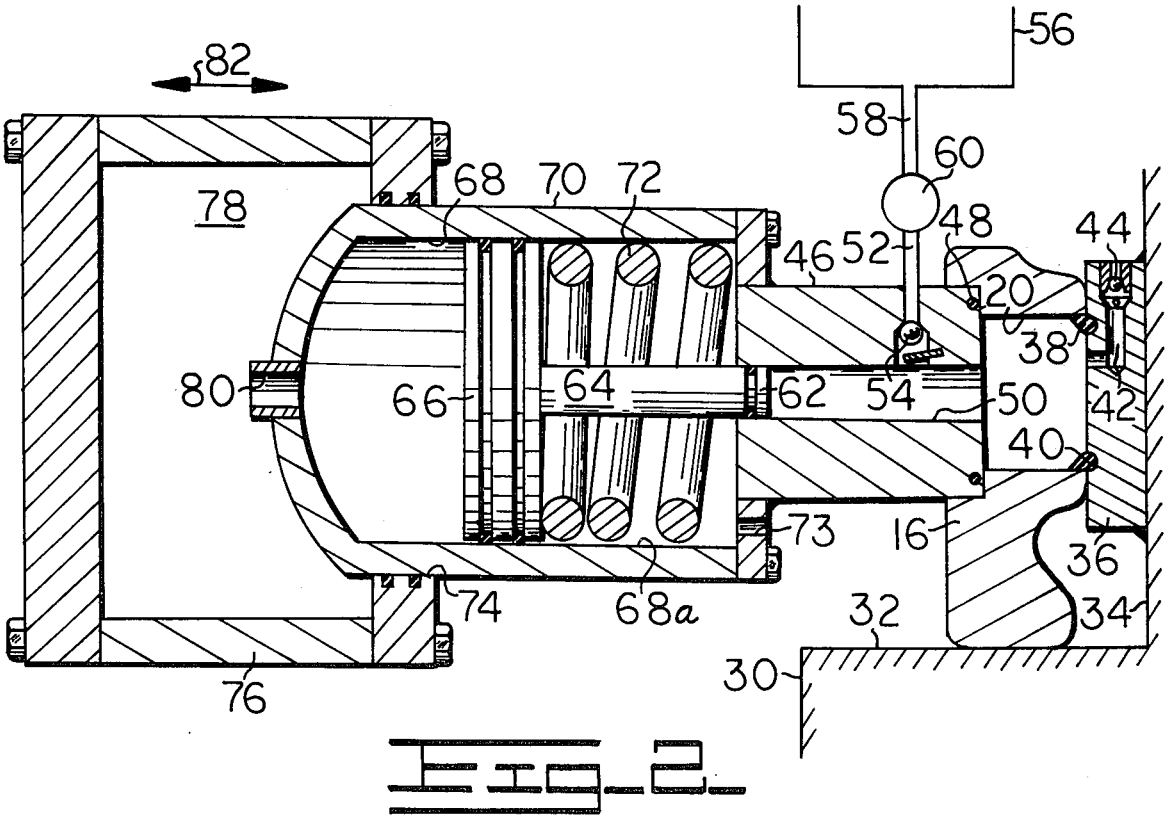

Turning now to FIG. 2, there is illustrated an example of suitable apparatus for carrying out the present invention. As illustrated, a suitable fixture 30 is provided having a suitable horizontal support surface 32 for supporting a work piece such as link 16. The fixture 30 further includes suitable clamping means including a vertically extending wall 34 extending upward at right angles from wall 32 and including means such as a clamping or reaction block 36 for engagment by the work piece. The clamping portion 36 includes suitable seal means such as an annular resilient seal member or the like 38 which may be retained in the suitable seat or the like 40 formed in the clamping block 36. Suitable vent means such as a passage 42 formed in block number 32 for communicating with the bore 20 of a work piece 16 and including suitable check valve means 44 may be provided.

The seal means 38 engages the ends of the bore 20 and as illustrated is adapted to be forced outward by means of the pressure within the bore 20 and thereby maintaining its sealing engagement with the bore. The opposite end of the bore 20 is engaged by suitable fluid pressure applying apparatus having means such as a barrel 46 for engaging the work member 16 around the bore 20 and including suitable seal means 48 for sealingly engaging same. The barrel 46 includes a cylindrical bore 50 communicating with the bore 20 of the work piece 16 and including means for such as an inlet passage 52 having check valve means 54 for controlling communication of fluid from a source such as a tank 56 communicating by way of conduit means 58 and valve means 60 with the inlet passage 52.

Suitable piston or plunger means 62 is reciprocably mounted within the bore 50 for movement toward the bore of the work piece for pressurizing hydraulic fluid introduced thereto. The piston 62 is suitably connected by rod means 64 to a second piston 66 which is reciprocably mounted within a suitable bore 68 of a housing 70. The second piston 66 is larger in diameter than the piston 62 and thus multiplies the force acting thereto. A suitable compression spring 72 is mounted within bore 68 for drawing the piston 62 away from the direction of the work piece 16. The spring chamber 68a is vented by an air bleed hole 73. The housing 70 is of a cylindrical configuration and reciprocably mounted within a bore 74 of a housing 76 having a chamber 78 defined therein. A suitable passageway 80 is provided between the bore 68 and chamber 78 of housing 76 so that pressurized fluid within chamber 78 acts upon piston 66. The housing 76 is preferably movably mounted on suitable means for movement toward and away from the work piece 16 by suitable force applying means. This movement may be along such as arrow 82.

In order to carry out the operation of the device, a work piece 16 having a bore 20 of a predetermined first diameter is suitably placed in the fixture 32 with seal means 38 suitably engaging the bore 20 for sealing one end thereof. The force applying means is brought into position with barrel 46 engaging the other end of the work piece and sealingly engaging bore 20 and a clamping force applied to the assembly to hold work piece 16 into position. A suitable hydraulic fluid is introduced into the bore 20 from a source such as a tank 56 by suitable valve means 60 communicating by way of bore 50 thereto. Air in bores 20 and 50 is vented by check valve means 44. When the bore 20 and bore 50 are full of fluid, the housing member 76 is moved to the right to apply pressure to the respective pistons and thus amplify the force thereof on the fluid within cylinder 50 and within the bore 20. Fluid is prevented from escaping from the bores by check valves 54 and 44. Movement of the housing 76 to the right forces fluid from chamber 78 into chamber 68 by way of passage 80 acting against piston 66 forcing plunger or piston 62 to the right along bore 50 thus increasing the pressure therein. This pressure is increased to beyond the yield strength of the wall of bore 20 to thereby increase the bore to the second predetermined diameter.

The housing 76 may be moved to the right in any suitable manner such as with a mechanical or hydraulic ram, for example. It should also be appreciated that housing 76 may be stationery and the piston 66 actuated by means of high pressure hydraulic fluid introduced into chamber 78.

An additional important aspect of this invention is the resultant localized strengthening of the bore material via prestretching into the inelastic range. After prestretching, the bore material will not yield inelastically at stresses up to the level induced by prestretching. Therefore, not only will the bore be properly sized, it will also be locally strengthened. By locally, is meant in the material near the bore inner diameter where stresses are much higher than those near the outer diameter. The level to which the material is strengthened will be above the yield point of the material but must be below the tensile strength to avoid breakage during prestretching. This results in a reduction in the amount of inelastic deformation of the bore which can take place when the final press fit is made.

Other changes and modifications to the illustrated embodiment may be apparent to those of ordinary skill in the art without departing from the spirit and scope of the invention as defined in the appended claims.

I claim:

1. A method of preparing a pin in tight press-fitting relation within a bore in a workpiece, comprising:
   - sizing and locally strengthening a bore in a workpiece by the steps comprising:
   - establishing a predetermined size for the bore;
   - forming an undersized version of said bore in a workpiece;
   - increasing the size of said bore by the steps of applying a hydrostatic pressure to the walls of said bore, raising said pressure to exceed the yield strength of said workpiece locally of the walls of said bore and continuing said pressure until the walls of said bore have yielded and deformed to said predetermined size and been locally strengthened; and
   - press-fitting a pin within said bore.

2. The method of claim 1 wherein said bore size increasing comprises the steps of:
   - sealing one end of said bore;
   - introducing a substantially incompressible fluid into the other end of said bore;
   - pressurizing said fluid until the wall of said bore yields to said 3. A method of preparing a pin in tight fitting relation within a bore in a workpiece, comprising:
   - enlarging a bore by the steps comprising:
     - forming a bore of a first predetermined diameter in a workpiece; and
     - enlarging said bore to a second predetermined diameter by the further steps of sealing said bore, introducing a pressurized fluid into said bore, increasing the pressure of said fluid to a pressure exceeding the yield strength of said workpiece until the walls of said bore expand locally while the remainder of the workpiece absorbs all the force of said fluid without external assist to said second predetermined diameter; and
   - press-fitting a pin within said bore.

* * * * *